US011661681B2

(12) United States Patent
Tsai

(10) Patent No.: US 11,661,681 B2
(45) Date of Patent: May 30, 2023

(54) MULTIFUNCTIONAL SMART GARMENT TEXTILE

(71) Applicants: Stephen Tsai, Cincinnati, OH (US); Hsien-Yin Tsai, Hsinchu (TW)

(72) Inventor: Stephen Tsai, Cincinnati, OH (US)

(73) Assignees: Stephen Tsai, Cincinnati, OH (US); Hsien-Yin Tsai, Hsinchu (TW)

( * ) Notice: Subject to any disclaimer, the term of this patent is extended or adjusted under 35 U.S.C. 154(b) by 302 days.

(21) Appl. No.: 17/029,244

(22) Filed: Sep. 23, 2020

(65) Prior Publication Data

US 2022/0025557 A1 Jan. 27, 2022

(30) Foreign Application Priority Data

Jul. 24, 2020 (TW) ..... 109125134

(51) Int. Cl.

| | |
|---|---|
| ***D02G 3/16*** | (2006.01) |
| ***D02G 3/44*** | (2006.01) |
| ***D02G 3/04*** | (2006.01) |
| ***H05B 3/34*** | (2006.01) |
| *D06M 11/74* | (2006.01) |
| *D06M 101/40* | (2006.01) |
| *D06M 15/37* | (2006.01) |

(52) U.S. Cl.

CPC ..... *D02G 3/16* (2013.01); *D02G 3/04* (2013.01); *D02G 3/441* (2013.01); *H05B 3/347* (2013.01); *D06M 11/74* (2013.01); *D06M 15/37* (2013.01); *D06M 2101/40* (2013.01); *D10B 2101/122* (2013.01); *D10B 2401/16* (2013.01); *H05B 2203/015* (2013.01)

(58) Field of Classification Search

CPC .. D02G 3/04; D02G 3/16; D02G 3/28; D02G 3/441

USPC ..... 57/238

See application file for complete search history.

(56) References Cited

U.S. PATENT DOCUMENTS

| | | | | |
|---|---|---|---|---|
| 9,833,027 | B2 | 12/2017 | Taylor et al. | |
| 10,447,178 | B1 * | 10/2019 | Hays | A45C 3/00 |
| 2012/0202397 | A1 * | 8/2012 | Wolf | H01B 1/24 977/932 |
| 2014/0150573 | A1 * | 6/2014 | Cannard | D03D 11/00 73/862.627 |
| 2014/0361662 | A1 * | 12/2014 | Al Ahmad | H02N 2/181 74/DIG. 9 |
| 2015/0366504 | A1 * | 12/2015 | Connor | A61B 5/6804 600/301 |
| 2018/0307314 | A1 * | 10/2018 | Connor | A61B 5/1123 |

FOREIGN PATENT DOCUMENTS

| | | | |
|---|---|---|---|
| CN | 104921316 | A | 9/2015 |
| CN | 206791721 | U | 12/2017 |
| TW | I663927 | B | 7/2019 |
| TW | 201929705 | A | 8/2019 |

OTHER PUBLICATIONS

Li-na Fan, Xue-cheng Xu, A Stable Iodine-Doped Multi-Walled Carbon Nanotube-Polypyrrole Composite With Improved Electrical Property (2015).*

Ravi M. A. P. Lima, Jose Jarib Alcarz-Espinoza, Fernando A. G. da Silva, Jr., Helinando P. de Oliveira, Multifunctional Wearable Electroinic Textiles Using Cotton Fibers With Polypyrrole and Carbon Nanotubes (2018).*

* cited by examiner

*Primary Examiner* — Shaun R Hurley

(74) *Attorney, Agent, or Firm* — Rosenberg, Klein & Lee

(57) ABSTRACT

A multifunctional smart garment textile is disclosed herein. It comprises plural conductive yarns, wherein each of the plural conductive yarns includes cotton threads, multiwalled carbon nanotubes and iodine-modified polypyrrole, and wherein the cotton threads, the multiwalled carbon nanotubes and the iodine-modified polypyrrole are intermingled with each other in a weight ratio ranging from 1:1:1 to 3:1:1.

2 Claims, No Drawings

MULTIFUNCTIONAL SMART GARMENT TEXTILE

BACKGROUND OF THE INVENTION

1. Field of the Invention

The present invention relates to a multifunctional smart garment textile which has better effects of electrical heating and thermal conductivity.

2. Description of Related Art

People who are engaged in outdoor activities (e.g. skiing) in cold or snowy areas or in low temperature environments usually need to wear warm clothes to avoid temperature loss. However, due to the limited choice of materials, the conventional electrical heating clothing has poor electrical heating effect, and usually only has a single function of electrical heating but no electricity conversion function. Therefore, users need to carry a large number of batteries or power chargers to provide enough power for long-term outdoor activities For instance, the U.S. Pat. No. 9,833,027B2, issued on 5 Dec. 2017, has disclosed a unitary garment heating device. It includes a plurality of fabric heating nodes connected by a unitary fabric heating conduit to generate uniform heat throughout the garment, and can be controlled by a remote communication device.

The Taiwan patent No. TW201929705A, published on 1 Aug. 2019, has disclosed a heating garment with environment condition sensing capability and a heating method thereof. The heating garment comprises a piece of clothing, a heating module, an environmental parameter sensor module to sense at least one environmental parameter, and an external control power module. The heating module, the environmental parameter sensor module and the external control power module respectively are disposed at appropriate positions on the clothing The external control power module is connected to the heating module and the environment parameter sensor module to supply power, receive sensed environment parameters from the environmental parameter sensor module, and control the heating of the heating module. Although the abovementioned heating garment has clothing heating function, the heating effect is limited, and it can only rely on batteries or external power sources for charging. Once the power is exhausted, the wearer must immediately find a place where the battery can be replaced or recharged. Therefore, the abovementioned heating garment is inconvenient for the wearers who work or engage in activities.

The Taiwan patent No. TWI663927B, issued on 1 Jul. 2019, has disclosed a smart clothing. It comprises a wearable element, a control module and an intelligent controller. The wearable element comprises a basic fabric as well as a light-emitting component and a heat-generating component coupled to the basic fabric. The control module electrically connects to the heat generating component, and the intelligent controller wirelessly connects to the control module, so the control module can be remotely controlled. The heat-generating component comprises circuits and carbon adhesives arranged on the basic fabric. The circuits contain conductive glues, and the weight ratio of the conductive glues to the carbon adhesives is about 1:1, 2:1 or 4:1. Although the abovementioned structure can achieve the active warning function and heat preservation effect of the clothing at the same time by the light-emitting element and the heating element on the wearable device and achieve a constant temperature effect by the carbon adhesives, it still has the disadvantage of not being able to store electricity or self-charging.

The China patent No. CN206791721U, issued on 26 Dec. 2017, has disclosed a solar charging heating clothes. It comprises a clothes body having an outer layer and an inside lining, and an upper pocket on a front thereof. It is characterized in that the clothes body further comprises a solar energy transformation absorber element group, a power conversion unit, a flexible zinc-base high energy density chargeable call, a LED lamp, a heating resistor card, a USB interface, and a switch for controlling the LED lamp and the heating resistor card. All elements are connected by conductive threads fixed between the outer layer and the inner lining of the clothes body. The abovementioned structure achieves the charging effect through complicated component settings, which is extremely inconvenient for wearers engaged in activities.

The China patent No. CN104921316A, published on 23 Sep. 2015, has disclosed a self-heating thermal clothes. It comprises a clothes inlaid with heating nets and a triboelectric nanogenerator. The triboelectric nanogenerator comprises a flexible conducting inner film, a flexible polymer layer and a conducting layer and is connected with the heating nets. Although the abovementioned thermal clothes can convert the kinetic energy generated by the human body during activities into electricity to drive the heating nets to generate heat, it still has disadvantages of complicated structure, complicated preparation process, high cost and not easy to wear.

SUMMARY OF THE INVENTION

In view of the above-mentioned problems, the object of the present invention is to provide a multifunctional smart garment textile, which has better electrical heating effect, flexibility, temperature controllability and thermal conductivity.

The multifunctional smart garment textile of the present invention comprises plural conductive yarns. Each of the plural conductive yarns includes cotton threads, multiwalled carbon nanotubes and iodine-modified polypyrrole, and the cotton threads, the multiwalled carbon nanotubes and the iodine-modified polypyrrole are intermingled with each other in a weight ratio ranging from 1:1:1 to 3:1:1.

According to an embodiment of the present invention, the multifunctional smart garment textile further comprises a piezoelectric material, and a weight ratio of the plural conductive yarns to the piezoelectric material is about 1:1-4:1. Preferably, the piezoelectric material is poly (vinylidenefluoride-co-trifluoroethylene) [P(VDF-TrFE)], or a copolymer of P(VDF-TrFE) and multiwalled carbon nanotubes (MWCNT).

According to an embodiment of the present invention, the multifunctional smart garment textile is set on a base fabric. Preferably, the base fabric is selected from a group consisting of polyester, modified polyester, nylon, modified nylon, polyurethane (PU), thermoplastic polyurethane elastomer (TPU) and acrylic resin.

Accordingly, the present invention achieves better effects of electrical heating and thermal conductivity, so it is suitable for users to wear during outdoor activities. Compared with the conventional electrical heating clothing materials, the multifunctional smart garment textile of the invention has much convenience in use.

DETAILED DESCRIPTION OF THE PREFERRED EMBODIMENT

Hereinafter, an exemplary embodiment of the present invention will be described in detail.

A multifunctional smart garment textile is disclosed herein. It mainly comprises plural conductive yarns, and each of the plural conductive yarns includes cotton threads, multiwalled carbon nanotubes (MWCNTs) and iodine-modified polypyrrole (PPy). Preferably, the cotton threads, the multiwalled carbon nanotubes and the iodine-modified polypyrrole are intermingled with each other in a weight ratio ranging from 1:1:1 to 3:1:1.

Accordingly, the multifunctional smart garment textile of the present invention used in a smart textile clothing can achieve the effect of keeping warm for a long time. Furthermore, the plural conductive yarns having a dense interweaving structure increase electrical conductivity and ensure the thermal conductivity of the multifunctional smart garment textile.

The multifunctional smart garment textile is further provided with a piezoelectric material to convert kinetic energy into electricity. Preferably, a weight ratio of the plural conductive yarns to the piezoelectric material is about 1:1-4:1. The piezoelectric material can be selected from poly (vinylidenefluoride-co-trifluoroethylene) [P(VDF-TrFE)], or a copolymer of P(VDF-TrFE) and multiwalled carbon nanotubes. Preferably, the piezoelectric material is the copolymer of P(VDF-TrFE) and multiwalled carbon nanotubes to obtain a high-voltage electrical coefficient of about 50 pm/V.

Since the piezoelectric material can convert kinetic energy into electricity as the human body moves, the plural conductive yarns and the piezoelectric material can be disposed in specific areas of the present invention to provide electrical energy to the wearer. In this way, the kinetic energy generated by wearer's body motion is converted into electricity to charge the multifunctional smart garment textile at any time even in outdoor activities so as to extend the heating time of the multifunctional smart garment textile.

Embodiment One: Test Conductivity

Referring to Table 1, the conductive yarns of the present invention are composed of cotton threads, MWCNTs and PPy with a weight ratio of 1.2:1:1, and its conductivity is 11.48 S/cm. Compared with the conductive yarns of the conventional materials, the present invention has high conductivity.

TABLE 1

| Material | Conductivity (S/cm) |
|---|---|
| Conductive yarns of the present invention | 11.48 |
| Polypyrrole (PPy) | $0.70 \times 10^{-3}$ |
| multiwalled carbon nanotubes (MWCNT) | 0.17 |
| MWCNT-PPy | 1.28 |
| iodine-modified PPy | 1.30 |

Embodiment Two: Test the Conversion Efficiency of Piezoelectric Materials

The piezoelectric material used in the present invention is P(VDF-TrFE), or a composite material polymerized by P(VDF-TrFE) and multiwalled carbon nanotubes (MWCNT) to convert mechanical kinetic energy into electricity.

Referring to Table 2, both materials have high piezoelectric coefficients. Due to the high density, the composite material polymerized by P(VDF-TrFE) and MWCNTs has high piezoelectricity and mechanical strength. In this way, even if the wearer is unable to charge immediately outdoors, the kinetic energy generated by the physical activities, e.g. walking or running, during the activities can still be transferred to the piezoelectric material and converted into electricity to achieve continuous charging and keep the plural conductive yarns in a heated state. Therefore, the present invention achieves the effect of keeping the wearer's body warm for a long time.

TABLE 2

| | Piezoelectric coefficient (piezoelectricity) (pm/V) | Mechanical strength (GPa) |
|---|---|---|
| P(VDF-TrFE) | 20-30 | 0.20 |
| P(VDF-TrFE)/MWCNT | 50 | 1.10 |

Compared with the conventional technique available now, the present invention has the following advantages:

1. The present invention uses cotton threads, multiwalled carbon nanotubes and iodine-modified polypyrrole which are intermingled with each other to form conductive yarns, so the present invention has better flexibility, temperature controllability and thermal conductivity.

2. The piezoelectric material with high piezoelectric coefficient of the present invention not only has the effect of electrical heating, but also has the effect of converting mechanical kinetic energy into electricity. When the present invention is applied as a smart textile garment, the kinetic energy generated by the physical activities of the wearer can be converted into electricity to provide charging. Compared with the conventional electrical heating clothing that cannot be charged outdoors, the present invention improves the convenience of use.

What is claimed is:

1. A multifunctional smart garment textile, comprising:

plural conductive yarns, wherein each of the plural conductive yarns includes cotton threads, multiwalled carbon nanotubes and iodine-modified polypyrrole, and wherein the cotton threads, the multiwalled carbon nanotubes and the iodine-modified polypyrrole are intermingled with each other in a weight ratio ranging from 1:1:1 to 3:1:1 and being set on a base fabric;

a piezoelectric material in a weight ratio of the plural conductive yarns to the piezoelectric material is about 1:1-4:1 disposed on specific areas of the base fabric for receiving kinetic energy generated by a wearer, the piezoelectric material is poly (vinylidenefluoride-co-trifluoroethylene), or a copolymer of poly (vinylidenefluoride-co-trifluoroethylene) and multiwalled carbon nanotubes.

2. The multifunctional smart garment textile as claimed in claim 1, wherein the base fabric is selected from a group consisting of polyester, modified polyester, nylon, modified nylon, polyurethane (PU), thermoplastic polyurethane elastomer (TPU) and acrylic resin.

* * * * *